US006871372B2

(12) United States Patent
Vosbikian et al.

(10) Patent No.: US 6,871,372 B2
(45) Date of Patent: Mar. 29, 2005

(54) MOP WITH CLEANING HEAD MEMBER AND SCRUBBER

(75) Inventors: Peter S. Vosbikian, Moorestown, NJ (US); Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 316 days.

(21) Appl. No.: 10/256,986

(22) Filed: Sep. 27, 2002

(65) Prior Publication Data

US 2004/0071490 A1 Apr. 15, 2004

(51) Int. Cl.[7] ..... A47L 13/12

(52) U.S. Cl. ..... 15/115; 15/118; 15/228; 15/231; 401/138

(58) Field of Search ..... 15/114, 115, 118, 15/228, 231; 401/137–140

(56) References Cited

U.S. PATENT DOCUMENTS

| | | | | | |
|---|---|---|---|---|---|
| 21,842 | A | * | 10/1858 | McClay | 15/115 |
| 702,998 | A | * | 6/1902 | Randolph | 15/115 |
| 1,563,829 | A | * | 12/1925 | Brown | 15/114 |
| 1,600,070 | A | * | 9/1926 | Serva | 15/114 |
| 1,685,265 | A | * | 9/1928 | Barber | 15/118 |
| 2,073,170 | A | * | 3/1937 | Pieper | 401/138 |
| 2,280,556 | A | * | 4/1942 | Stromgren | 401/196 |
| 2,472,781 | A | * | 6/1949 | Vosbikian et al. | 15/146 |
| 2,943,339 | A | * | 7/1960 | Vosbikian et al. | 15/118 |
| 3,795,933 | A | * | 3/1974 | Seufert | 15/114 |
| 4,802,782 | A | * | 2/1989 | Scalf | 401/138 |
| 5,483,720 | A | * | 1/1996 | Decoopman et al. | 15/119.2 |
| 6,216,307 | B1 | * | 4/2001 | Kaleta et al. | 15/119.2 |
| 6,588,045 | B2 | * | 7/2003 | Fernandez | 15/119.2 |
| 2003/0074756 | A1 | * | 4/2003 | Policicchio et al. | 15/228 |

FOREIGN PATENT DOCUMENTS

| | | | |
|---|---|---|---|
| DE | 3400625 | * | 5/1984 |

* cited by examiner

*Primary Examiner*—Mark Spisich
(74) *Attorney, Agent, or Firm*—Stuart M. Goldstein

(57) ABSTRACT

A mop with a platen-shaped cleaning head member, to be used for dry or wet applications, with or without cleaning sheets, suited to be used as a liquid dispensing mop. An abrasive scrubber support is integrally formed with and extends from the forward upper surface of the cleaning head member. An abrasive scrubber component is secured to the support. The cleaning head member is connected to the mop's handle by a swivel joint which permits easy and ready rotation of the cleaning head member, 360° in relation to the handle. This permits unencumbered positioning of the abrasive scrubber, for efficient and effective cleaning of ingrained soiled surfaces. After this cleaning is completed, the cleaning head member can easily be rotated back to its primary cleaning position.

6 Claims, 8 Drawing Sheets

MOP WITH CLEANING HEAD MEMBER AND SCRUBBER

BACKGROUND OF THE INVENTION

Wet and dry mops have been used as popular and efficient cleaning tools for many years. A form of mop which has become increasingly popular, especially for wet mop application, employs a platen-shaped cleaning head member connected to a mop handle. The cleaning head member is used to clean, polish, or dust floor, wall, or similar surfaces. Routinely, a separate removable fabric or fabric-like synthetic material cleaning sheet, which is either disposable or washable and reusable, is attached to the cleaning head member. It is this cleaning sheet which actually contacts the surface to the cleaned. Such removable sheets allow the mop to enjoy a variety of different uses—both in wet and dry applications, e.g. general mopping and cleaning, dusting, polishing, buffing, etc. When a cleaning sheet becomes soiled, it can be washed or disposed of and a replacement sheet attached to the cleaning head member.

Currently this type of cleaning appliance is being used as the basic design for what has become to be known as liquid dispensing mops. These mops expel soapy water, floor cleaning solutions, wax, or similar liquids, which are immediately used for wet cleaning/polishing application by the mop, with or without a cleaning sheet. Examples of such mops are seen in U.S. Pat. Nos. 4,119,386, 4,971,471, and 6,101,661. However, while these and similar liquid dispensing mops are efficiently and effectively used for smooth, floor-type surface cleaning, waxing and absorption capability, they are not effective to remove ingrained, soiled areas or surfaces. For this, an abrasive scrubber member, such as a brush, wire attachment, abrasive surface strip, or the like, allows for the scrubbing and cleaning of ingrained soiled surfaces. This enhances the capability and versatility of mop with a soft mop head, which only functions efficiently when used for light surface cleaning or moisture absorption.

Abrasive scrubber type members have been used on a variety of different types of mops. As early as the late nineteenth century, brush surfaces were added to mops, as seen in the pivoted press plate sponge mop shown in U.S. Pat. No. 603,000. Other examples of abrasive brush surfaces on mops of varied configurations include U.S. Pat. No. 2,472,781, showing a brush mounted on a one piece sponge mop; U.S. Pat. No. 4,491,998, disclosing an abrasive scrubber mounted on a roller type sponge mop; U.S. Pat. No. 5,488,750, which employs a unique abrasive scrubber unit employed on a butterfly sponge mop; and U.S. Pat. No. 6,085,378 in which a scrubber is used on a swab mop.

To date, however, there has been no attempt to employ the use of an abrasive scrubber system on the platen-shaped cleaning head members which are on liquid dispensing mops and dry mops of similar design. This may be because the configuration of the cleaning head members of such mops, with their relatively thin design height in relation to their length, makes it difficult to maneuver the head members, in other than their normal cleaning position. The head members are not designed to be tilted, turned over, rotated, and positioned—movements which are required if an abrasive scrubber element is to be used in combination with the mop. This is particularly true of mops with pivoted handles, which most of these designs are. Attempts to use a scrubber member on such mops in positions other than the only one for which they were designed, would, as a practical matter, be difficult and ineffective. In addition, handle mounted components of the liquid dispensing mops would serve to interfere and inhibit attempts to use the mop in other than its designed cleaning position. With the increased popularity of these types of mops, there is a need for an effective system of incorporating an abrasive scrubber element.

SUMMARY OF THE INVENTION

Accordingly, it is the object of the present invention to overcome the limitations and deficiencies of prior mops with platen-shaped cleaning head members—used both for dry application and wet application, including liquid dispensing mops.

It is the object of the present invention to increase the versatility of mops with platen-shaped cleaning head members.

It is a further object of the present invention to provide a mop with a platen-shaped cleaning head member with the capability of successfully cleaning ingrained soiled surfaces.

It is still another object of the present invention to provide a mop with a platen-shaped cleaning head member with an abrasive scrubber system which is designed and formed to be readily and easily used on such mops.

It is yet another object of the present invention to provide a mop with a platen-shaped cleaning head member which employs an integrated abrasive scrubber system to position the mop in order to clean ingrained soiled surfaces easily, in an unencumbered manner.

It is a further object of the present invention to provide a mop with a platen-shaped cleaning head member which has means, in the form of a swivel joint, to rotate the cleaning head member in relation to the handle of the mop, for ease of positioning the mop's abrasive scrubber on ingrained, soiled surfaces and then returning the head member to its normal cleaning position.

The present invention comprises a mop with a platen-shaped cleaning head member. The mop is used for dry or wet applications, with or without cleaning sheets and is particularly suited to be used as a liquid dispensing mop. An abrasive scrubber support is integrally formed with and extends from the forward upper surface of the cleaning head member. An abrasive scrubber component is secured to the support. The cleaning head member is connected to the mop's handle by a swivel joint which permits easy and ready rotation of the cleaning head member, 360° in relation to the handle. This permits unencumbered positioning of the abrasive scrubber, for efficient and effective cleaning of ingrained soiled surfaces. After this cleaning is completed, the cleaning head member can easily be rotated back to its primary cleaning position.

The novel features which are considered as characteristic of the invention are set forth in particular in the appended claims. The invention, itself, both as to its design, construction, and use, together with additional features and advantages thereof, are best understood upon review of the following detailed description with reference to the accompanying drawings.

DETAILED DESCRIPTION OF THE INVENTION

Figure 9:
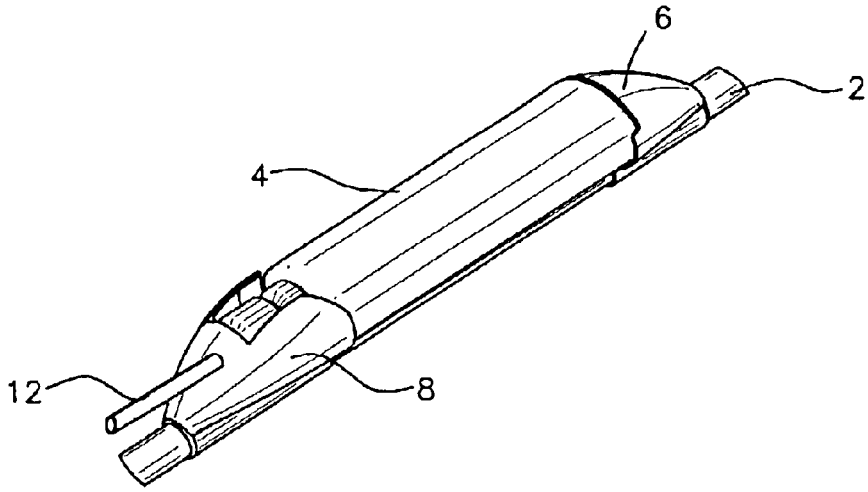
FIG. 9 is a view of the mop's container in place on the handle.
Figure 10:
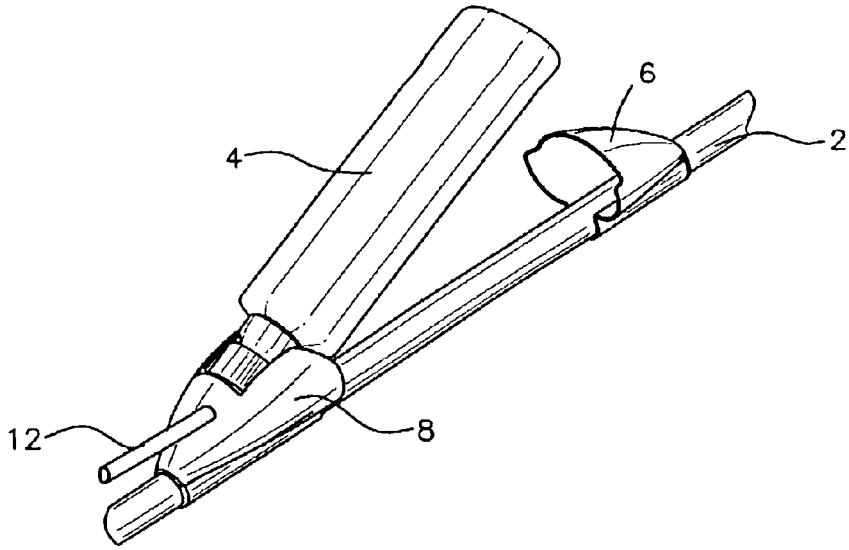
FIG. 10 is a view of the mop's container being removed from the handle.
Figure 11:
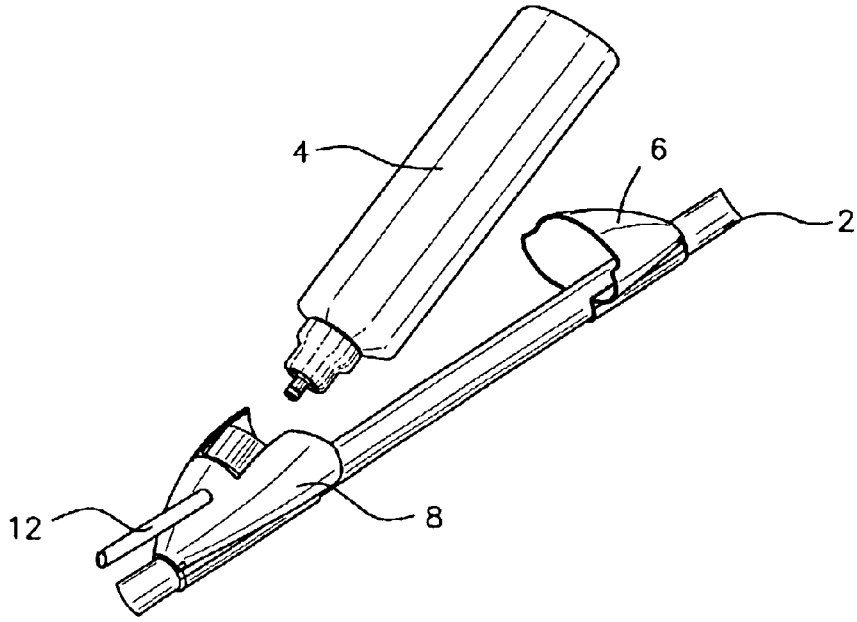
FIG. 11. Is a view of the mop's container separated from the handle.

Mop 1 of the present invention is shown in the drawings in the form of a liquid dispensing mop with handle 2 supporting container 4, to be filled with water, detergent, waxing or other liquid cleaning substance. Container 4 is supported and held in place by holders 6 and 8. FIGS. 9–11 show the sequence of removing container 4 from handle 2. Switch 10 is configured such as to instigate release of the liquid cleaning substance through tube 12 and then for dispersal through nozzle 14. These components of the mop, as shown, are generally known in the art. It is contemplated, however, that the subject matter of the present invention will be used for mops with platen-shaped cleaning head members employed in dry cleaning applications as well.

Figure 1:
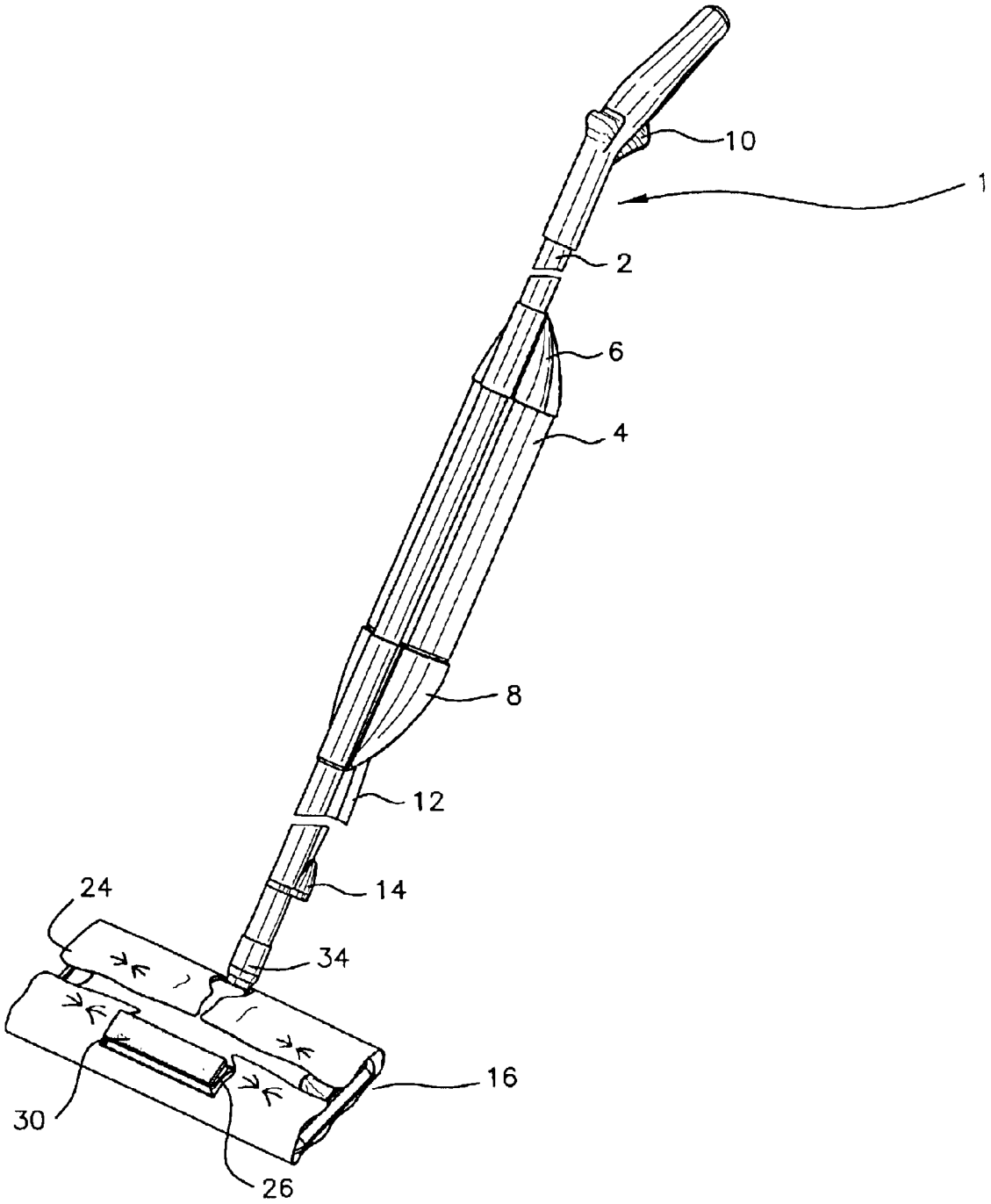
FIG. 1 is an isometric view of the mop of the present invention with cleaning sheet attached.
Figure 2:
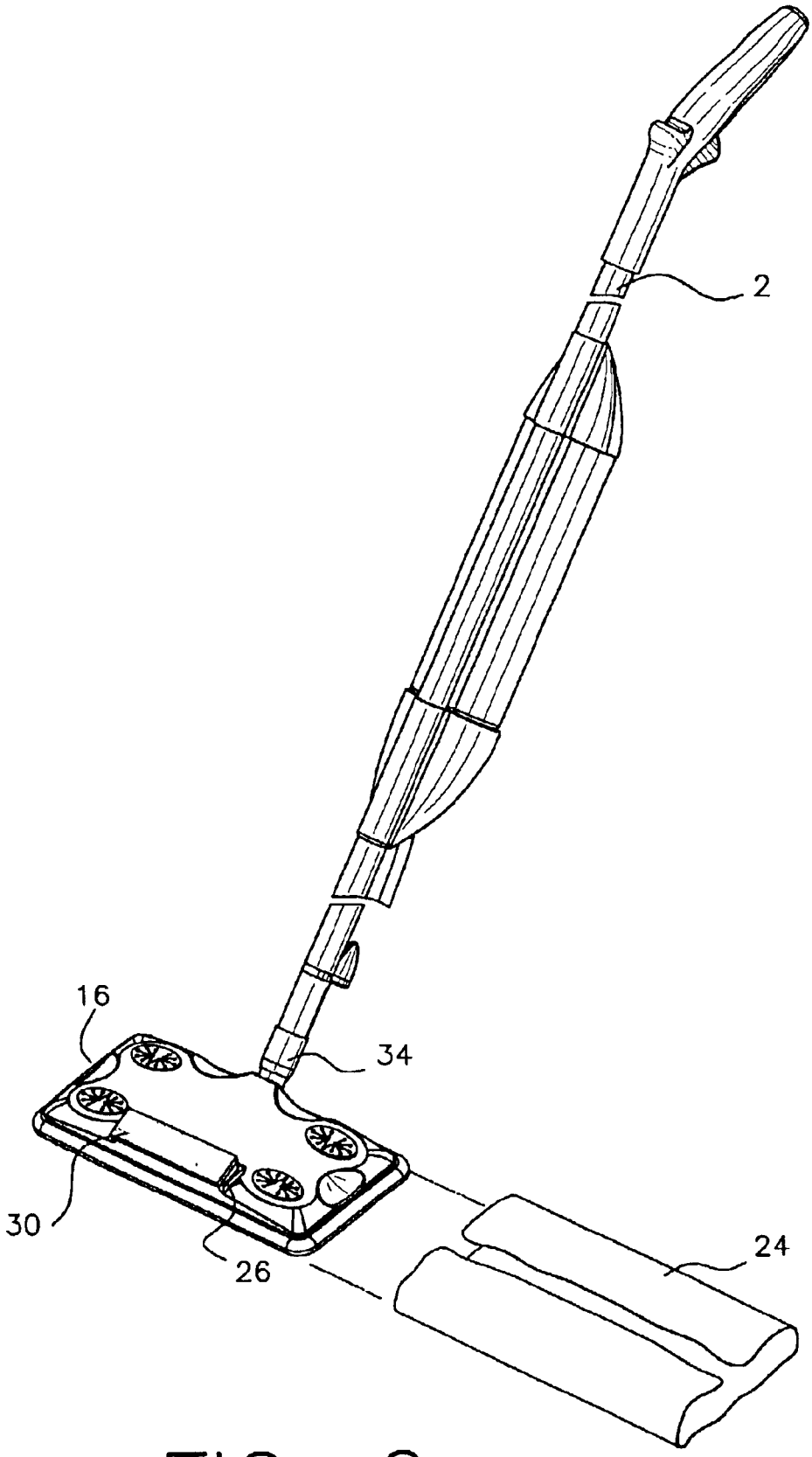
FIG. 2 is an isometric view of the present invention showing its cleaning sheet removed.
Figure 3:
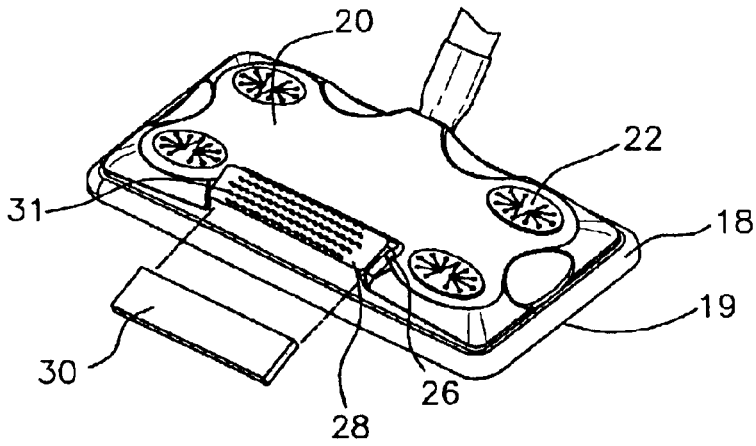
FIG. 3 is a view of the cleaning head member of the present invention, with one type of abrasive scrubber member removed.
Figure 4:
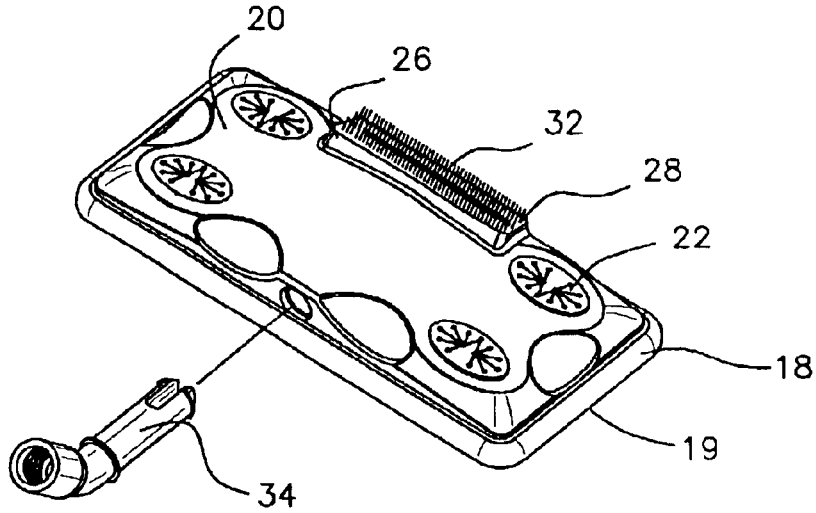
FIG. 4 is a view of the cleaning head member of the present invention with a brush as the abrasive scrubber member and showing the swivel joint component.
Figure 5:
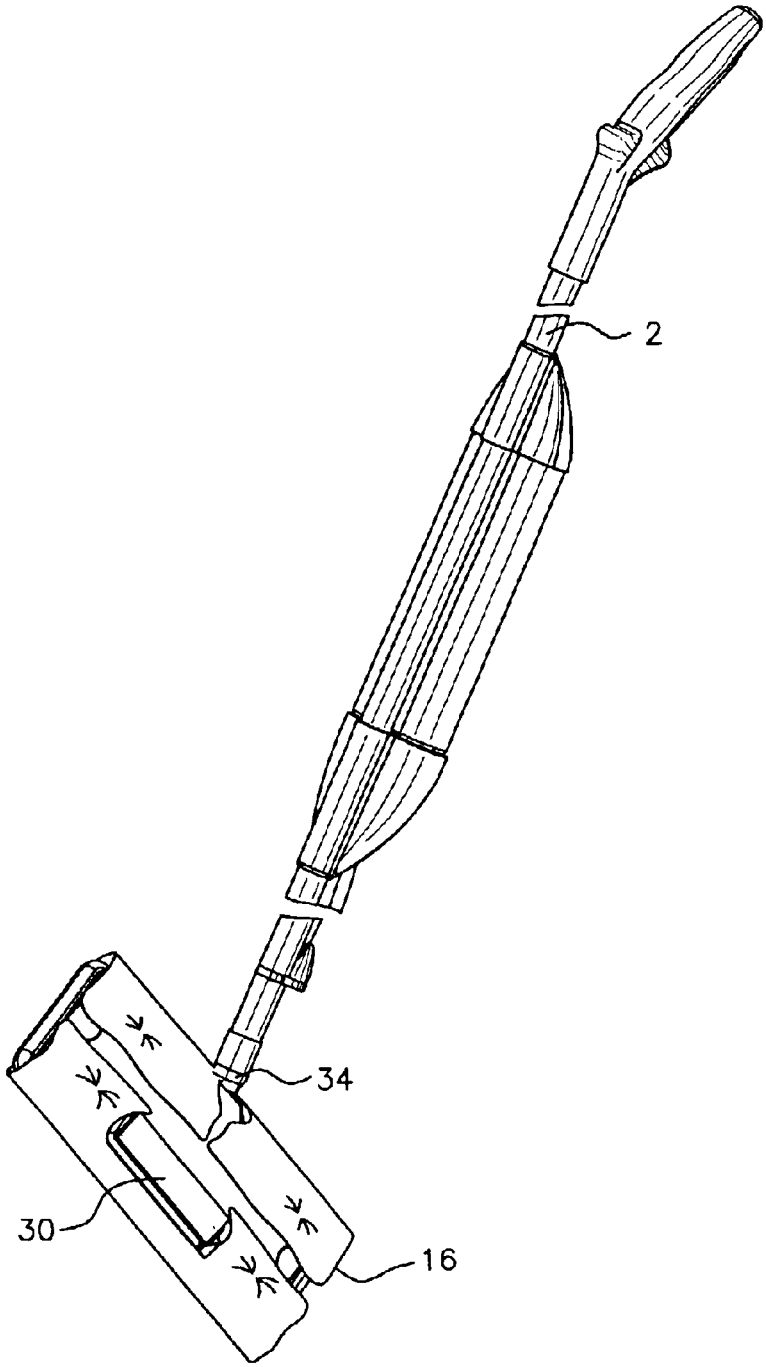
FIG. 5 is an isometric view of the present invention, beginning cleaning head member rotation for using its scrubber member.
Figure 6:
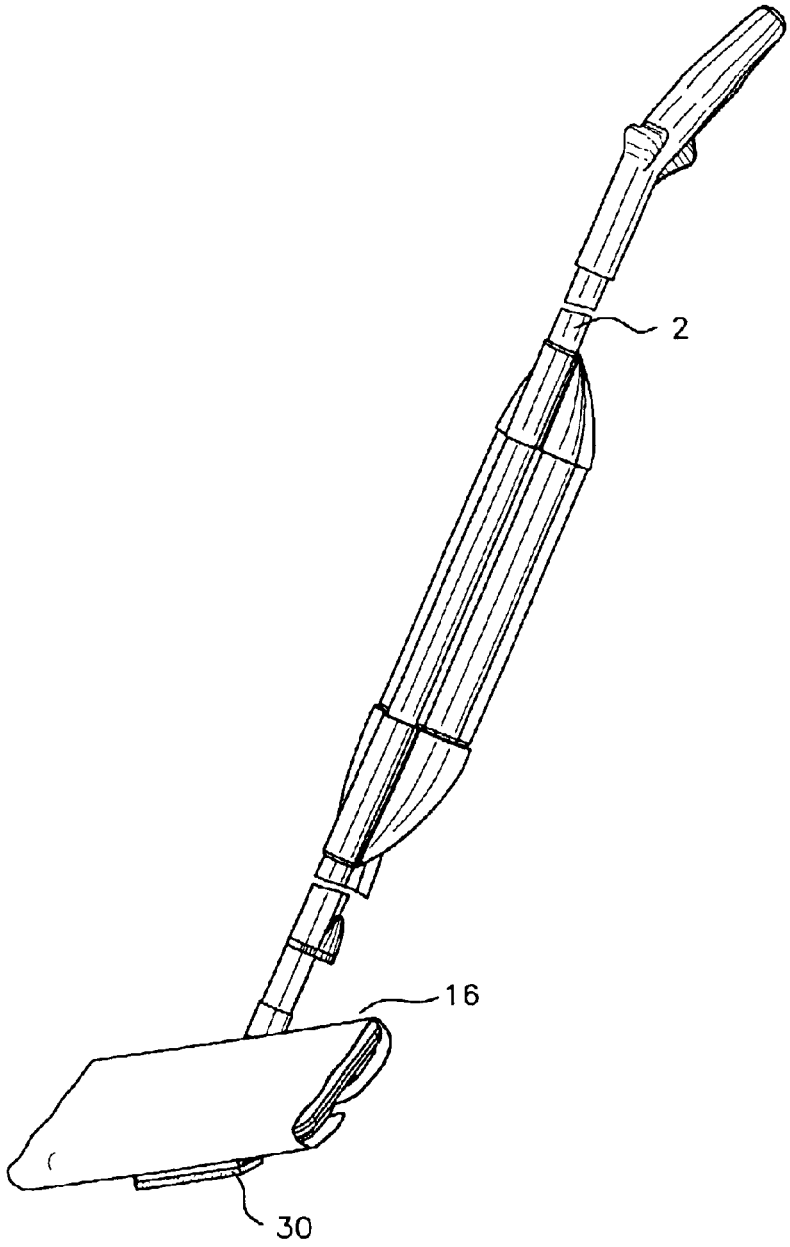
FIG. 6 is an isometric view of the present invention as the cleaning head member continues its rotation from the position shown in FIG. 5.

Mop 1 comprises platen-shaped cleaning head member 16 with a pad 18 with a flat bottom surface 19 and upper surface 20. Commonly used cleaning sheet attachments 22 are used to secure a cleaning sheets 24 over cleaning head member 16. Upper surface 20 of cleaning member 16 comprises scrubber support 26 which extends outwardly and is integrally formed from the upper surface. Scrubber support 26 has outer surface 28 and attached to that surface is abrasive scrubber member 30. Scrubber member 30 can be an abrasive pad or similar course surface which can be permanently attached to outer surface 28 or attached by means of Velcro® 31 or similar means. It can also be appreciated that the abrasive scrubber member can be scrubber brush or like scrubbing element 32 as shown in FIG. 4. Brush 32 can be secured to cleaning head member 16 by permanent attachment to scrubber support 26, by Velcro®, or other known means. The invention is not limited in scope to the type of abrasive scrubber elements which are disclosed herein, nor by manner of attachment of the elements to cleaning head member 16.

This configuration permits cleaning member head 16, with or without cleaning sheet 24 attached, to be rotated 180° in either direction, to allow scrubber members 30 or 32 to be used to clean ingrained, soiled surfaces. After cleaning with scrubber members 30 and 32 is completed, cleaning head member 16 is again rotated back to its normal cleaning position.

While cleaning head member 16 with scrubber members 30 and 32 can be used on a mop with a mop handle which is more rigidly secured or even pivoted to cleaning head member 16, an added feature of the invention incorporates rotatable swivel joint 34, which results in a unique combination when used with the cleaning head member and scrubber member as previously described.

Swivel joint 34 is secured at one end to handle 2 and at its other end to cleaning head member 16. An example of a swivel joint which is adaptable for use herein is shown and described in detail in U.S. Pat. No. 5,379,478. However, the scope of the invention is not limited to this particular joint. Equivalent rotatable handle-to-cleaning head member joints are contemplated. Such a joint permits cleaning head member 16 to rotate, unencumbered, 360° in relation to mop handle 2.

Figure 7:
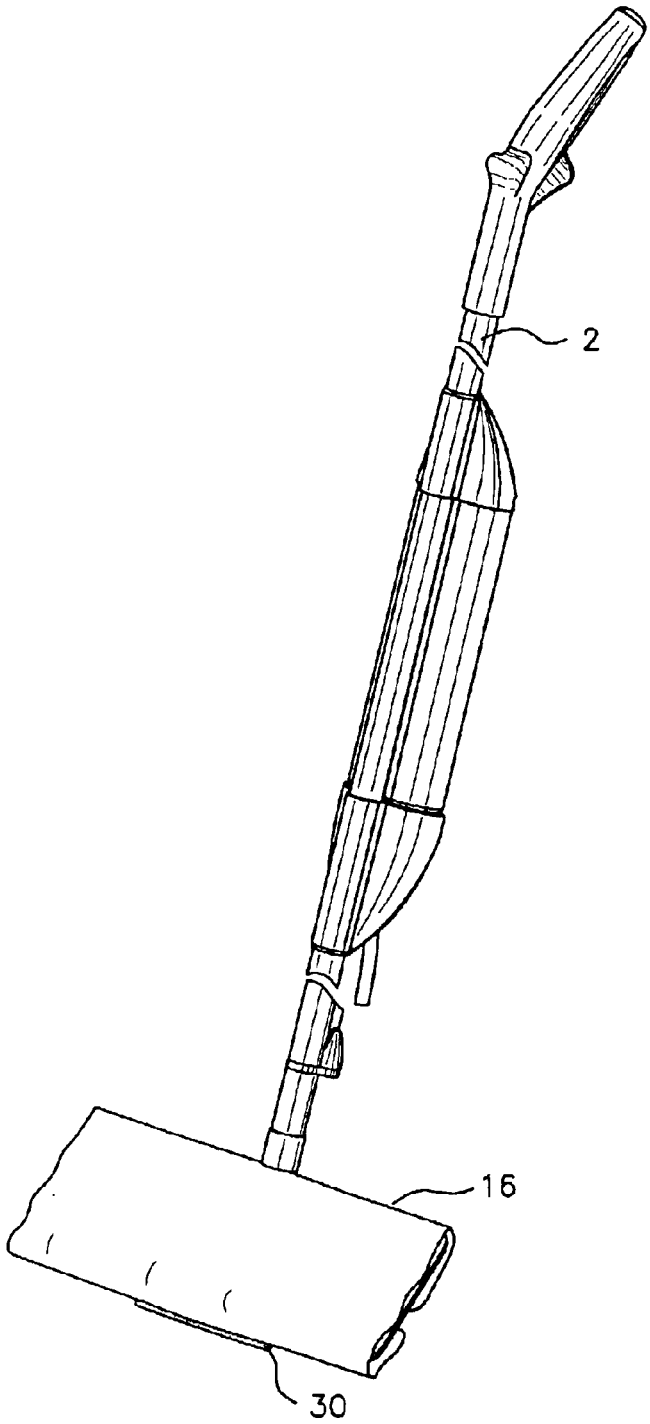
FIG. 7 is an isometric view of the present invention showing the cleaning head member rotated in position for using the scrubber member.
Figure 8:
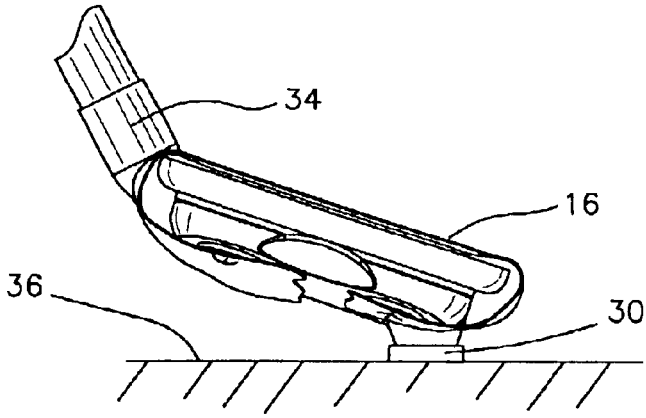
FIG. 8 is a side view of cleaning head member in position for using the scrubber member.

FIGS. 1, 5–8 show various positions of mop 1, as cleaning head member 16 is rotated about handle 2 from its normal cleaning position (FIG. 1), 180° to a position such that cleaning member is inverted so that scrubber member 30 can be used on cleaning surface 36 (FIGS. 7 and 8). After scrubber member 30 is used, cleaning head member 16 can be rotated in either direction, back to its normal cleaning position. This configuration allows easy rotation of cleaning head member 16, when scrubber member 30 is to be used, without actually having to rotate handle 2, resulting in a much simpler and effective scrubbing operation. By this configuration, cleaning head member 16 also can be rotated without turning the entire mop upside-down, making it easier to position the cleaning member in an unencumbered manner, without interference with the cleaning sheet which is being used or disruption of any other components, such as liquid dispensing components, which may be on the mop.

Certain novel feature and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed is:

1. A mop for use with a separable cleaning sheet, said mop comprising:

an elongated handle;

a unitary cleaning member secured at one end of the handle, said cleaning member comprising an upper surface and a substantially flat bottom surface;

connecting means for securing the handle and the cleaning member and for rotating the cleaning member 360° in relation to the handle;

a scrubber support integral with and extending outwardly from the front of the upper surface of the cleaning member;

an abrasive scrubber means for cleaning ingrained, soiled surfaces, said scrubber means being secured to the scrubber support such that it is, at all times, permanentiy fixed and maintained in position in relation to the upper surface of the cleaning member;

a cleaning sheet;

means to secure the cleaning sheet over the bottom surface of the cleaning member and around the abrasive scrubber means, whereby the connecting means is configured to rotate the cleaning member, with cleaning sheet secured thereto, and the abrasive scrubber means approximately 180° to substantially invert the cleaning member such that the upper surface of the cleaning member is positioned below the bottom surface of the cleaning member and the abrasive scrubber means is in contact with the soiled surfaces.

2. The mop as in claim 1 wherein the connecting means permits rotation of the cleaning member in relation to the handle without interference with or disruption of the cleaning sheet or any other components of the mop.

3. The mop as in claim 1 wherein the connecting means comprises a swivel joint.

4. The mop as in claim 1 wherein the abrasive scrubber means is an abrasive pad.

5. The mop as in claim 1 wherein the abrasive scrubber means is a brush element.

6. The mop as in claim 1 further comprising liquid dispensing means for wet surface cleaning applications.

* * * * *